US008136815B2

(12) United States Patent
Van

(10) Patent No.: US 8,136,815 B2
(45) Date of Patent: Mar. 20, 2012

(54) INTERACTIVE BRAINTEASER PUZZLE

(76) Inventor: Vinh Van, Monterey Park, CA (US)

( * ) Notice: Subject to any disclaimer, the term of this patent is extended or adjusted under 35 U.S.C. 154(b) by 194 days.

(21) Appl. No.: 12/756,884

(22) Filed: Apr. 8, 2010

(65) Prior Publication Data

US 2010/0259000 A1 Oct. 14, 2010

Related U.S. Application Data

(60) Provisional application No. 61/167,547, filed on Apr. 8, 2009.

(51) Int. Cl.
*A63F 9/08* (2006.01)

(52) U.S. Cl. ..... 273/153 S; 273/153 R

(58) Field of Classification Search ..... 273/153 S, 273/153 R, 157 R, 142 H, 142 R, 142 HA
See application file for complete search history.

(56) References Cited

U.S. PATENT DOCUMENTS

| | | | | | |
|---|---|---|---|---|---|
| 564,022 | A | * | 7/1896 | Murphy | 273/153 S |
| 598,889 | A | * | 2/1898 | Young | 273/153 R |
| 679,782 | A | * | 8/1901 | Reenstierna | 273/153 R |
| 782,594 | A | * | 2/1905 | Brown | 273/153 S |
| 814,653 | A | * | 3/1906 | Healey | 273/153 S |
| 1,270,947 | A | * | 7/1918 | Hermann | 273/153 R |
| 1,579,341 | A | * | 4/1926 | Allen | 273/142 HA |
| 2,541,411 | A | * | 2/1951 | Culwell | 273/153 R |
| 3,829,100 | A | | 8/1974 | Nielsen | |
| 4,474,371 | A | | 10/1984 | Silbermintz | |
| 4,580,783 | A | | 4/1986 | Cohan | |
| 4,715,605 | A | | 12/1987 | Fritzman | |
| 4,752,074 | A | * | 6/1988 | Juang | 273/153 R |
| 4,978,126 | A | | 12/1990 | Morosow et al. | |
| 5,172,912 | A | * | 12/1992 | Lammertink | 273/153 S |
| D334,600 | S | | 4/1993 | Imohi | |
| 5,244,208 | A | | 9/1993 | Kalapacs | |
| 6,217,022 | B1 | * | 4/2001 | Astaneha | 273/142 HA |
| 2009/0096160 | A1 | | 4/2009 | Lyons, Jr. | |
| 2009/0309302 | A1 | | 12/2009 | Langin-Hooper | |

* cited by examiner

*Primary Examiner* — Steven Wong
(74) *Attorney, Agent, or Firm* — Thien Tran, Esq; Access Patent Group, LLC

(57) ABSTRACT

An interactive brainteaser puzzle which includes a circular base having a central recess, a raised collar about the central recess, a raised rim about the periphery, a plurality equally spaced radial lines extending between the raised collar and the raised rim to form a plurality of wedge shaped spaces thereabout and a plurality of apertures, wherein each aperture is located in one wedge shaped space. A plurality of pegs is provided, wherein each peg is of a size to removably fit into the central recess and any of one of the apertures. A plurality of wedge shaped plates are also provided, wherein each wedge shaped plate is of a size to extend between the raised collar and the raised rim to manually slide within the circular base and stop on any one of the wedge shaped spaces.

16 Claims, 3 Drawing Sheets

INTERACTIVE BRAINTEASER PUZZLE

CROSS-REFERENCE TO RELATED APPLICATION

This application claims the benefit of Provisional Patent Application No. 61/167,547, filed on Apr. 8, 2009, in the United States Patent & Trademark Office, the disclosure of which is incorporated herein by reference.

BACKGROUND OF THE INVENTION

1. Field of the Invention

The present invention relates to a puzzle, and more particularly, a brainteaser puzzle. Many puzzles on the market are uncomplicated and do not challenge the player to a great extent. Parents are always looking for new ways to entertain their children with a mind enhancing activity. Many of the games meant for children are simple and do not require a complex thought process. Even adults wish they had a unique way to pass the time while testing their limits. Amore stimulating activity is desired. The brainteaser puzzle is a changeling puzzle that requires logic and color pattern recognition to solve. The puzzle is designed to exercise the mind and test the wits of players ages ten and up. There are only a few possible solutions for the puzzle, which requires the player to follow specific color patterns. This interactive brainteaser puzzle is an exciting new alternative to boring outdated games.

2. Description of the Prior Arts

Numerous innovations for puzzles have been provided in the prior art that will be described. Even though these innovations may be suitable for the specific individual purposes to which they address, however, they differ from the present invention.

A FIRST EXAMPLE, U.S. Pat. No. 3,829,100, Issued on Aug. 13, 1974, to Nielsen teaches an educational puzzle in which there is a base member having a plurality of recesses therein, a corresponding number of pegs, each of a different color, and a corresponding number of blocks, each of the same color as one of the pegs. The blocks, when properly assembled, form a continuous layer of the same outline and size as the base member, so as to cover the base member. Preferably, the base member is circular and the pieces have largely arcuate edge walls. In assembly, the child places the pegs in the recesses in the base member and then places over each peg a block of the same color as the peg over which the block is placed, adjusting the angular position of the block until its fits snugly against the contiguous block or blocks.

A SECOND EXAMPLE, U.S. Pat. No. 4,580,783, Issued on Apr. 8, 1986, to Cohan teaches a puzzle having at least two overlapping circles disposed in a base, each circle being defined by a number of petals and a number of triangles. Each of the petals is formed of two arcs which are portions of a circle of the same circumference as each of the overlapping circles, and the triangles have faces in the form of arcs complementary to the arcs of the petals. The overlapping circles have common component petals and triangles, and rotation of either of the circles causes displacement of the common components. The petals and triangles have complementary tongues and grooves. The portion of the base underneath the circles has upwardly directed partial annular ridges, and the petals and triangles are provided with downwardly directed extensions which engage and are guided by the sides of the ridges.

A THIRD EXAMPLE, U.S. Pat. No. 4,978,126, Issued on Dec. 18, 1990, to Morosow et al. teaches a rotating amusement device having two or more overlapping circle members which are independently rotatable with the overlapping sections being rotatable into the bodies of any or all of the overlapping circles or into a different overlapping of circles. The device can be utilized as a puzzle wherein various possible overlapping sections are differently colored or shaped and the object is to obtain a predetermined color combination or shape configuration. The circle members are comprised of interlocking elements with a peripheral frame holding the circles in such interlocking position while permitting the independent rotation of each of the circles. Increase in the number of overlapping circles adds to the complexity by increasing the number of possible permutations.

A FOURTH EXAMPLE, U.S. Pat. No. D334,600, Issued on Apr. 6, 1993, to Imohi teaches an ornamental design for a puzzle, as shown and described.

A FIFTH EXAMPLE, U.S. Pat. No. 5,244,208, Issued on Sep. 14, 1993, to Kalapacs et al. teaches a logical mosaic-puzzle, which is built-up of a given number of elements, where between the two main elements, the casing and the clamping frame there are mosaic toy-elements connected to each other loosely. The toy-elements are formed in such a manner that they can be turned on circles extending into or overlapping each other, about the axis of the circles and simultaneously compared to the other circles. Moreover the circles each consist of 6 toy-elements, out of which one toy-element forms the part of three different circles while the other circles are also formed of 6 toy-elements each, which can be ranged into two different groups, and which toy-elements are provided with projections joining each other, the casing and the clamping-frame; and with grooves taking up these projections. The number of the toy-elements can be 13, 16 or 19.

It is apparent now that numerous innovations for puzzles have been provided in the prior art that adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a brainteaser puzzle which avoids the disadvantages of the prior art.

ANOTHER OBJECT of the present invention is to provide a brainteaser puzzle that is simple and inexpensive to manufacture.

STILL ANOTHER OBJECT of the present invention is to provide a brainteaser puzzle that is simple to use.

BRIEFLY STATED, STILL YET ANOTHER OBJECT of the present invention is to provide a brainteaser puzzle which comprises a circular base having a central recess, a raised collar about the central recess, a raised rim about the periphery, a plurality equally spaced radial lines extending between the raised collar and the raised rim to form a plurality of wedge shaped spaces thereabout and a plurality of apertures, wherein each aperture is located in one wedge shaped space. A plurality of pegs is provided, wherein each peg is of a size to removably fit into the central recess and any of one of the apertures. A plurality of wedge shaped plates are also provided, wherein each wedge shaped plate is of a size to extend between the raised collar and the raised rim to manually slide within the circular base and stop on any one of the wedge shaped spaces.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWINGS

Figure 1A:
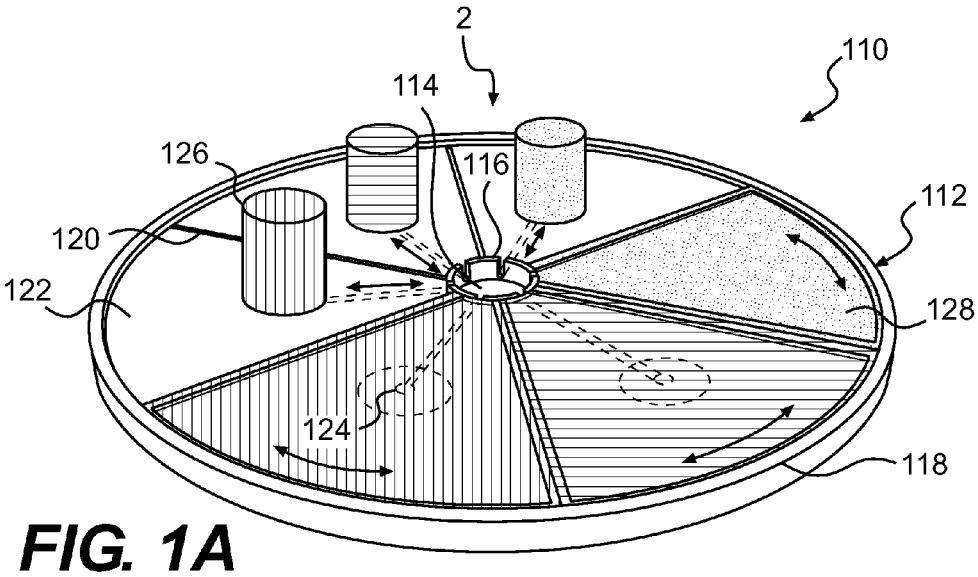
FIG. 1A is a perspective view of the first stage configuration.
Figure 1B:
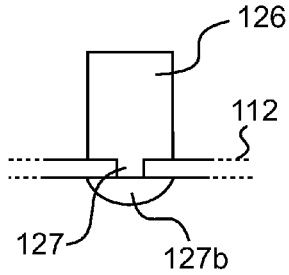
FIG. 1B is a cross-section of a peg.
Figure 2:
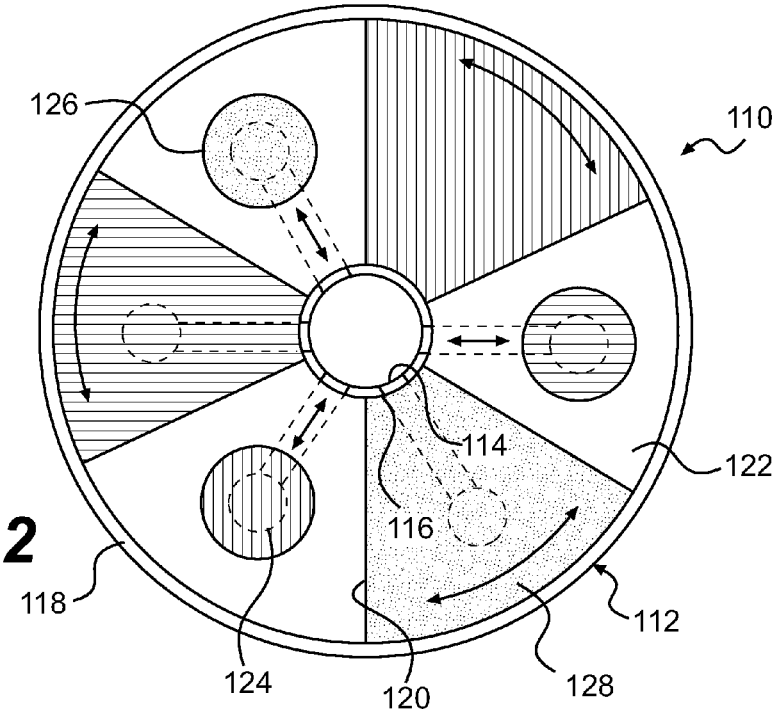
FIG. 2 is a top plan view taken in the direction of arrow 2 in FIG. 1 showing the present invention in a first stage configuration with symmetric peg-plate color patterns.
Figure 3:
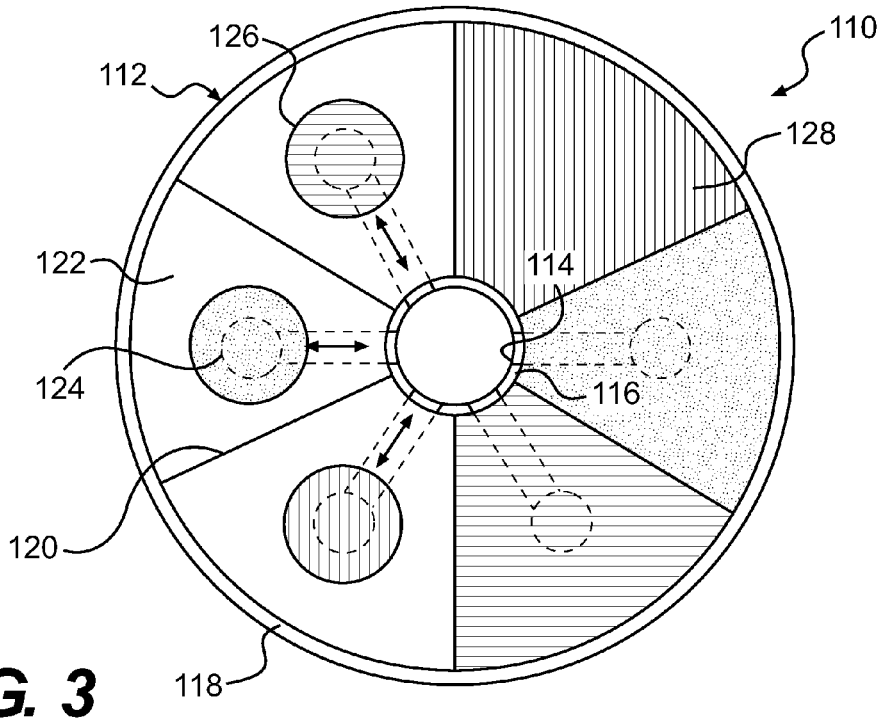
FIG. 3 is a top plan view similar to FIG. 2 in a completed first stage configuration with pegs one side and plates one side symmetric color patterns.

110 brainteaser puzzle
112 circular base of brainteaser puzzle 110
114 central recess in circular base 112
116 raised collar on circular base 112
118 raised rim of circular base 112
120 radial line on circular base 112
122 wedge shaped spaces on circular base 112
124 aperture in wedge shaped space 122
126 peg of brainteaser puzzle 110
127 bottom pin of the peg 126
127B cap of the bottom pin 127
128 wedge shaped plate of brainteaser puzzle 110
130A inner cut-out portion on the raised collar 116 of the recess 114
130B outer cut-out portion on the rim 118

DETAILED DESCRIPTION OF THE PREFERRED EMBODIMENT

Referring now to the figures, in which like numerals indicate like parts, and particularly to FIGS. 1 through 5, and as such, will be discussed with reference thereto.

The present invention is a interactive brainteaser puzzle 110 which comprises a circular base 112 having a central recess 114, a raised collar 116 about the central recess 114, a raised rim 118 about the periphery, a plurality of N equally spaced radial lines 120 extending between the raised collar 116 and the raised rim 118 to form a plurality of N wedge shaped spaces 122 thereabout and a plurality of (N−1) apertures 124, wherein each aperture 124 is located in one wedge shaped space 122. There is one wedge shape space that does not have any aperture. The blank wedge shape space serves as a parking space to make the puzzle harder to play. Each aperture 124 is slottedly connected through the central recess 114. At least (N−1) slots are provided. In the first stage configuration, N is equal six (06). So, there are six (06) wedge shape spaces 122, five (05) apertures 124, five (05) cut-out portions 130A and five (05) slots.

A plurality of pegs 126 is provided. Each peg 126 is of a size to removably fit into the central recess 114 and any of one of the apertures 124. The pegs 126 can be shifted or pushed only through the slots back and forth between the apertures 124 and the central recess 114. The pegs 126 can't be picked up from the base 112. An inner cut-out portion is provided on the raised collar 116 of the recess 114. A plurality of wedge shaped plates 128 is also provided. Each wedge shaped plate 128 is of a size to extend between the raised collar 116 and the raised rim 118 to manually slide within the circular base 112 and stops on any one of the wedge shaped spaces 122.

Each of the pegs 126 is comprised of a different color. Each of the wedge shaped plates 128 is comprised of a different color but in pair with the peg's color. Each of the pegs 126 is comprised of a color corresponding to one of the wedge shaped plates 128. Each of the wedge shaped spaces 124 of the circular base 112 are of equal size to that of each of the wedge shaped plates 128. The central recess 114 and the apertures 124 in the circular base 112 are of a circular shape. The pegs 126 are uniform rods of substantially the same circular cross section as the central recess 114 and the apertures 124 in the circular base 112. Each of the pegs 126 has a bottom-pin 127 (see FIG. 1B). The bottom-pin 127 is capped with a cap 127B in order to prevent the peg being pick up from the base 112. The bottom-pin 127 allows the peg 126 to be shifted or pushed only. In the first stage configuration, there are three (03) pegs 126 and three (03) wedge shape plates 128.

The circular base 112 can be approximately 1/10 of an inch to three quarters of an inch in thickness and between five (05) to ten (10) inches in diameter. It can be produced in various sizes, and colors. The wedge shaped plates 128 may be red, white and blue; however, additional colors may be added by utilizing an additional ring of wedge shaped plates 128 to enhance the challenge (see FIG. 5). The second $2^{nd}$ ring is just an outer ring to the first ring (circular base) of the first stage configuration. The $2^{nd}$ ring is also divided into six (06) spaces. Three additional $2^{nd}$ pegs and three $2^{nd}$ additional wedge shape plates are also used. The $2^{nd}$ level pegs and $2^{nd}$ level wedge shaped plates in pair have to be matched in color. One blank space is reserved and has no aperture. The apertures on the additional or outer ring are connected to the apertures of the first or inner ring of the first stage configuration via slots and via cut-out portions 130B.

The interactive brainteaser puzzle 110 can be made from wood, plastic, metal or other suitable material.

Color patterns are determined by moving the pegs 126 to their correct positions and moving the wedge shaped plates 128 along the wedge shaped spaces 122 clockwise and counterclockwise. The wedge shaped plates 128 can be slid into a particular space 122 only if that particular peg 126 (of that particular space) is moved (via a cut-out portion 130A) to the central recess 114.

Figure 4:
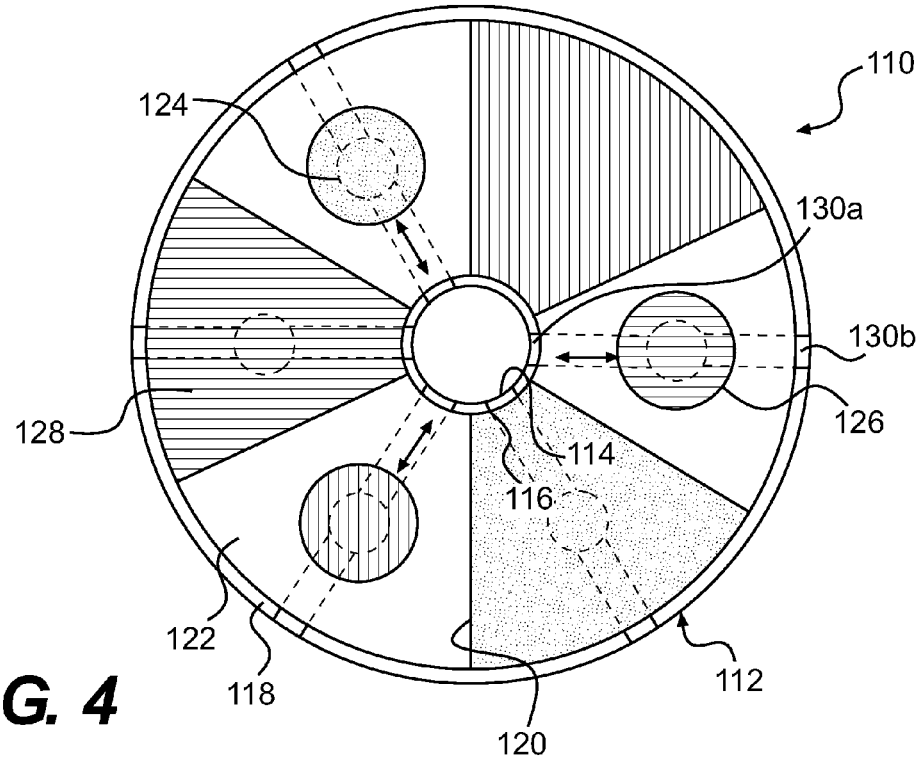
FIG. 4 is a top plan view similar to FIG. 3 in a completed first stage configuration with symmetric peg-plate color patterns and cut-out portions at the circular rim for receiving additional ring of plates.
Figure 5:
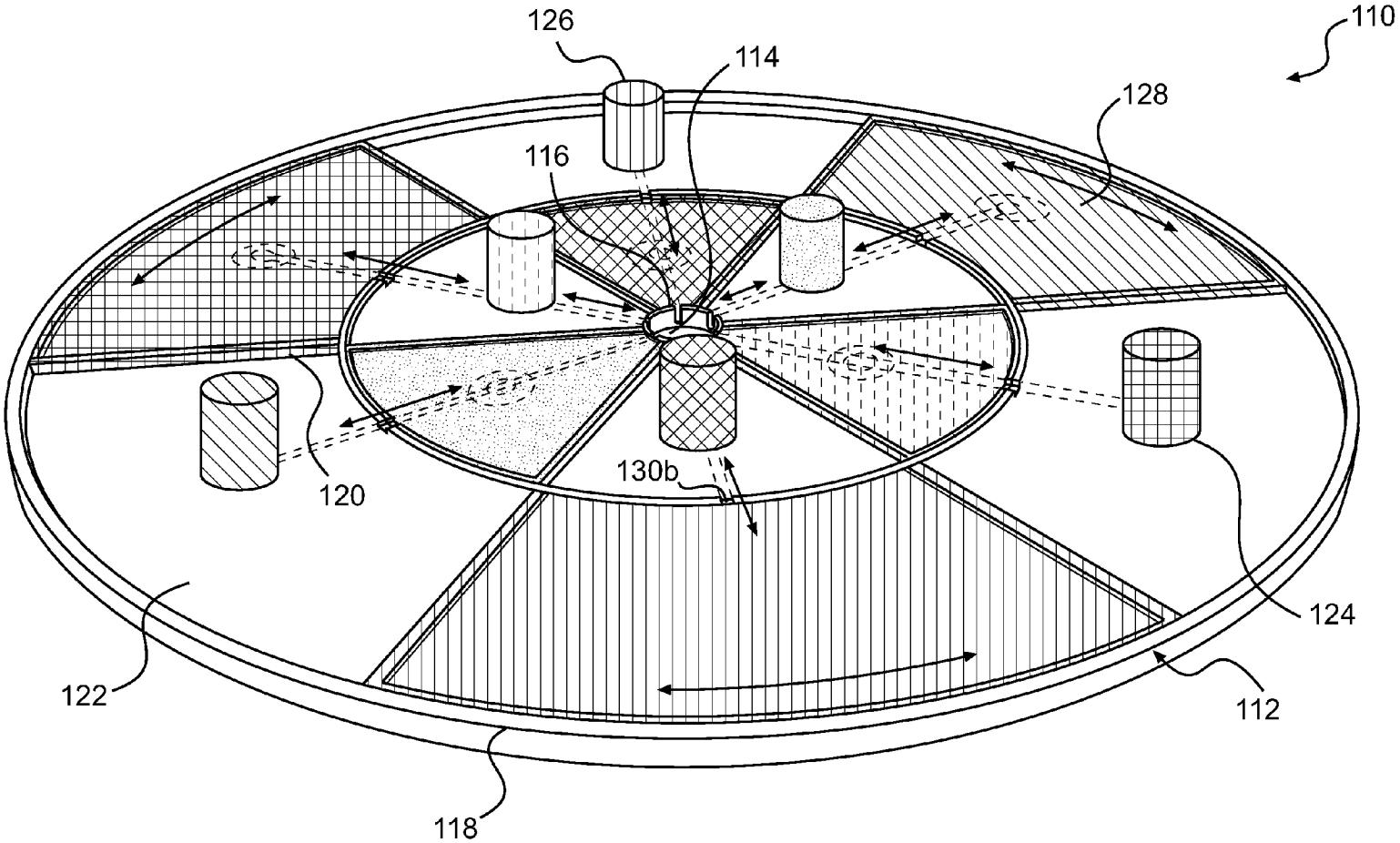
FIG. 5 is a perspective view showing a more complex version combining first stage and second stage configuration.

The central recess 114 and the apertures 124 are indented approximately one half inch deep to hold the pegs 126 upright. The interactive brainteaser puzzle 110, starting from FIG. 2 (symmetric peg-plate color patterns), is solved when the desired color patterns are completed, which include three pegs 126 on one side and three wedge shaped plates on the other side of the circular base 112 (see FIG. 3). Another more complicated end scenario is to have the three wedge shaped plates 128 separated between the three pegs 126 (see FIG. 4). FIG. 4 shows a completed first stage configuration with symmetric peg-plate color patterns and cut-out portions at the circular rim for receiving additional ring of plates. An outer cut-out portion 130B is provided on the rim 118 if additional ring of plates is provided. At the first stage configuration, there are only three (03) pegs 126 and three (03) wedge shaped plates 128 and six wedge shaped spaces 122 (including five (05) wedge shaped spaces 122 with five apertures 124 and one blank wedge shaped space 122).

There is no limit to how many layer of additional ring of plates that can be add on to increase the difficulties of the puzzle.

The game can be used to help enhance and stimulate the complexity of a person's mind. It's a great activity for any person to exercise his/her mind with this game that requires logic and color pattern recognition in order to solve.

The game can be applied in any institution or non-institution environment such as schools, offices, and or even private homes for personal leisure activities and entertainments.

It will be understood that each of the elements described above, or two or more together, may also find a useful application in other types of constructions differing from the types described above.

While the invention has been illustrated and described as embodiments of a brainteaser puzzle, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An interactive brainteaser puzzle allowing player to achieve different specific color patterns in a first stage configuration which comprises:

a) a circular base having a central recess, a raised collar about the central recess, a raised rim about the periphery, a plurality equally spaced radial lines extending between the raised collar and the raised rim to form a plurality of wedge shaped spaces thereabout and a plurality of apertures, wherein each the aperture is located in one the wedge shaped space;

b) a blank wedge shaped space does not include an aperture;

c) a plurality of pegs, wherein each said peg being of a size to removably fit into said central recess and each of one of said apertures, wherein the pegs can be shifted or pushed back and forth only;

d) a plurality of slots connecting between said apertures and the central recess, which allows the pegs being shifted back and forth, and e) a plurality of wedge shaped plates, wherein each said wedge shaped plate being of a size to extend between said raised collar and said raised rim to manually slide within said circular base and stop on any one of said wedge shaped spaces.

2. The puzzle as recited in claim 1, wherein each of said pegs is comprised of a different color in red, white and blue.

3. The puzzle as recited in claim 1, wherein each of said wedge shaped plates is comprised of a different color in red, white, blue.

4. The puzzle as recited in claim 2, wherein each of said pegs is comprised of a color corresponding to one of said wedge shaped plates.

5. The puzzle as recited in claim 1, wherein each of said wedge shaped spaces of said circular base are of equal size to that of each of said wedge shaped plates.

6. The puzzle as recited in claim 1, wherein said central recess and said apertures in said circular base are of circular shape and in which said pegs are uniform rods of substantially the same circular cross section as said central recess and said apertures in said circular base.

7. The puzzle as recited in claim 1, wherein additional spaces on an additional ring, additional pegs, additional wedge shaped plates can be provided for the second stage configuration in a similar fashion of first stage configuration.

8. The puzzle as recited in claim 1, wherein puzzle's material is selected from a group consisting of wood, plastic, and metal.

9. The puzzle as recited in claim 1, wherein the circular base can be approximately 1/10 of an inch to three quarters of an inch in thickness and between five (05) to ten (10) inches in diameter.

10. The puzzle as recited in claim 1, wherein each of the pegs having a pin and cap on the bottom to retain the pegs to the circular base.

11. The puzzle as recited in claim 7, wherein the additional ring is just an outer ring to the circular base of the first stage configuration.

12. The puzzle as recited in claim 11, wherein the outer ring is also divided into six (06) spaces.

13. The puzzle as recited in claim 11, wherein three additional $2^{nd}$ pegs and three $2^{nd}$ additional wedge shape plates are also used.

14. The puzzle as recited in claim 11, wherein the $2^{nd}$ level pegs and $2^{nd}$ level wedge shaped plates in pair have to be matched in color.

15. The puzzle as recited in claim 11, wherein one blank space on the outer ring has no aperture.

16. The puzzle as recited in claim 11, wherein the apertures on the additional or outer ring are connected to the apertures of the first or inner ring of the first stage configuration via slots and via cut-out portions.

* * * * *